United States Patent [19]

Rupp

[11] Patent Number: 4,472,115

[45] Date of Patent: Sep. 18, 1984

[54] FLUID-OPERATED RECIPROCATING PUMP

[75] Inventor: Warren E. Rupp, Mansfield, Ohio

[73] Assignee: The Warren Rupp Company, Mansfield, Ohio

[21] Appl. No.: 415,474

[22] Filed: Sep. 7, 1982

[51] Int. Cl.[3] ..... F04B 43/06

[52] U.S. Cl. ..... 417/393; 91/311

[58] Field of Search ..... 417/393; 91/311, 329

[56] References Cited

U.S. PATENT DOCUMENTS

| | | | |
|---|---|---|---|
| 3,782,863 | 1/1974 | Rupp | 91/329 X |
| 3,791,768 | 2/1974 | Wanner | 91/329 X |
| 4,008,984 | 2/1977 | Scholle | 417/393 |

FOREIGN PATENT DOCUMENTS

| | | | |
|---|---|---|---|
| 813047 | 9/1951 | Fed. Rep. of Germany | 91/311 |
| 2060086 | 4/1981 | United Kingdom | 417/393 |

*Primary Examiner*—Leonard E. Smith

*Attorney, Agent, or Firm*—Pearne, Gordon, Sessions, McCoy, Granger & Tilberry

[57] ABSTRACT

A fluid-operated reciprocating pump having a central housing, a pair of chamber housings attached to opposite sides of the central housing, and a pumping diaphragm in each chamber housing that separates an inner pressure chamber from an outer pressure chamber. Each outer pressure chamber is connected to an inlet manifold and a discharge manifold, and one-way check valves control the flow of the material being pumped through the chamber. The pumping diaphragms are connected together by a connecting rod that extends through the central housing. The central housing is formed by a pair of identical, generally tubular, molded sections secured to one another in reverse relationship to define inlet and outlet ports for operating fluid, a reversing valve chamber, a pilot valve chamber, and passages connecting the reversing valve chamber to the pilot valve chamber, the inlet port and the inner pressure chambers. A reversing valve is slidably mounted in the reversing valve chamber to control the supply of operating fluid to alternate from one inner chamber to the other, and a pilot valve is slidably mounted in the pilot valve chamber to control the movement of the reversing valve. The pilot valve is controlled by a member associated with the connecting rod and located within the central housing. According to one aspect of the disclosure, the one-way check valves are neither gravity-sensitive nor otherwise sensitive to the positioning of the pump, and the inlet and discharge manifolds are located adjacent one another so that the pump may be oriented with the check valves above the outer pressure chamber (such as where the material being pumped has air or other gas entrained therein) or with the check valves below the outer pressure chambers (such as where the material being pumped has solids entrained therein).

9 Claims, 6 Drawing Figures

FLUID-OPERATED RECIPROCATING PUMP

BACKGROUND OF THE INVENTION

This invention relates to fluid-operated, reciprocating pumps, and especially to double-diaphragm-type pumps that utilize a reversing valve to control the reciprocating, pumping action. More particularly, the invention relates to simplification of the construction of such pumps, to the operation of a pilot valve for controlling the reversing valve, and to the provision of a capability for operating such pumps with their intake and exhaust manifolds at either a high level or a low level position.

Fluid-operated pumps, such as diaphragm pumps, are widely used particularly for pumping liquids, solutions, viscous materials, and slurries or suspensions. The word "liquid" as used herein is intended to include all such materials. Typical diaphragm pumps of this general type are shown in my earlier U.S. patents listed below:

| | |
|---|---|
| 3,304,126 | 3,782,863 |
| 3,514,227 | 3,814,548 |
| 3,741,689 | 3,860,034 |
| 3,741,692 | |

Other double-diaphragm pumps are shown in the patents listed below:

| | |
|---|---|
| 2,625,886 | 3,652,187 |
| 2,679,209 | 3,791,768 |
| 2,780,177 | 3,838,946 |
| 3,192,865 | 4,019,838 |
| 3,338,171 | 4,123,204 |
| 3,548,716 | 4,172,698 |

Double-diaphragm pumps of the type disclosed in the above-listed prior art patents are well known for their utility in pumping thickened or solids-laden liquids, as well as for pumping plain water, other liquids, and low-viscosity solutions based on such liquids. Accordingly, double-diaphragm pumps have found extensive use in pumping out sumps, shafts, and pits, and generally in handling a great variety of slurries, sludges, and waste-laden liquids. Pneumatically-driven diaphragm pumps offer certain further advantages in convenience, effectiveness, portability, and safety. In pumps of this type, the cylindrical casing of the pump is normally mounted in a substantially horizontal position, the diaphragms are disposed vertically, the connecting rod between them moves back and forth in a substantially horizontal direction, both diaphragms communicate with intake and discharge ports, and the air exhaust line vents to atmosphere. Double-diaphragm pumps are rugged and compact and, to gain maximum flexibility, are often served by a single intake line and deliver liquid through a short manifold to a single discharge line.

Among the difficulties experienced with prior art pumps are the heavy construction due to the forming of the housing from castings, which require considerable machining prior to assembly. Also, the control systems, including a reversing valve and normally a pilot valve to control the reversing valve, have embodied designs that add to the cost and complexity of construction.

While most double-diaphragm pumps of the prior art are operated pneumatically, others are hydraulically operated where the circumstances are suitable. The capability for operating such pumps with other than air pressure is highly desirable, such as where suitable compressors are not available. One very simple source of operating fluid is the water obtainable from a local water utility line where the pressure head is normally between 60 and 100 feet. In many situations, the water at line pressure can be readily used and the exhausted water collected and used locally for various purposes.

The novel pump construction of the present invention satisfies many of the difficulties and unique requirements described above, and affords other features and advantages heretofore not obtainable.

SUMMARY OF THE INVENTION

It is among the objects of the present invention to simplify the construction of double-diaphragm-type pumps.

Another object of the invention is to simplify and improve the operation of a pilot valve for controlling the reversing valve used in a double-diaphragm-type pump of the type described.

Still another object of the invention is to provide a double-diaphragm pump that may be oriented with its intake and exhaust manifolds either above the pumping chambers or below the pumping chambers to satisfy the requirements of different pumping applications.

A further object of the invention is to provide a double-diaphragm-type pump that may use water at line pressure from the local utility as the primary or operating fluid for pumping the secondary fluid, or in other words the material to be pumped.

These and other objects and advantages are achieved by the fluid-operated reciprocating pump construction of the invention, the pump including as basic components a central housing, a pair of chamber housings each disposed at an opposite side of the central housing, a pair of diaphragms, one in each of the chamber housings and dividing the interior of each chamber housing into inner and outer pressure chambers. The outer pressure chambers are connected to inlet and discharge manifolds, and one-way check valves are provided to control the flow through the pump. The pumping members or diaphragms are connected together by a connecting rod for synchronized reciprocating movement in their respective chambers, and the connecting rod extends through the central portion of the central housing.

In accordance with the invention, the central housing comprises a pair of identical molded housing sections secured to one another in reverse relationship to define inlet and outlet ports for operating fluid, a reversing valve chamber, a pilot valve chamber, and passages connecting the reversing valve chamber to the pilot valve chamber, the inlet port, and the inner pressure chambers. A reversing valve is slidably mounted in the reversing valve chamber to control the supply of operating fluid to alternate from one inner chamber to the other, and a pilot valve is slidably mounted in the pilot valve chamber to control the movement of the reversing valve. The pilot valve is controlled by a member associated with the connecting rod and located within the central housing.

According to one aspect of the invention, the one-way check valves are neither gravity-sensitive nor otherwise sensitive to the positioning of the pump, and the inlet and discharge manifolds are located adjacent one another so that the pump may be oriented with the check valves above the outer pressure chambers (such as where the material being pumped has air or other gas entrained therein) or with the check valve below the outer pressure chambers (such as where the material being pumped has solids suspended therein).

In accordance with one aspect of the invention, the pilot valve comprises an elongated, spool-type element adapted for reciprocating linear movement in a direction generally perpendicular to the direction of movement of the connecting rod. The pilot valve operating member, which is carried by the connecting rod, has generally radially extending bifurcations with cam surfaces thereon adapted alternatingly to engage the valve element to shift it between its operating positions in response to reciprocating movement of the flexible pumping diaphragms.

DESCRIPTION OF THE PREFERRED EMBODIMENT

Figure 1:
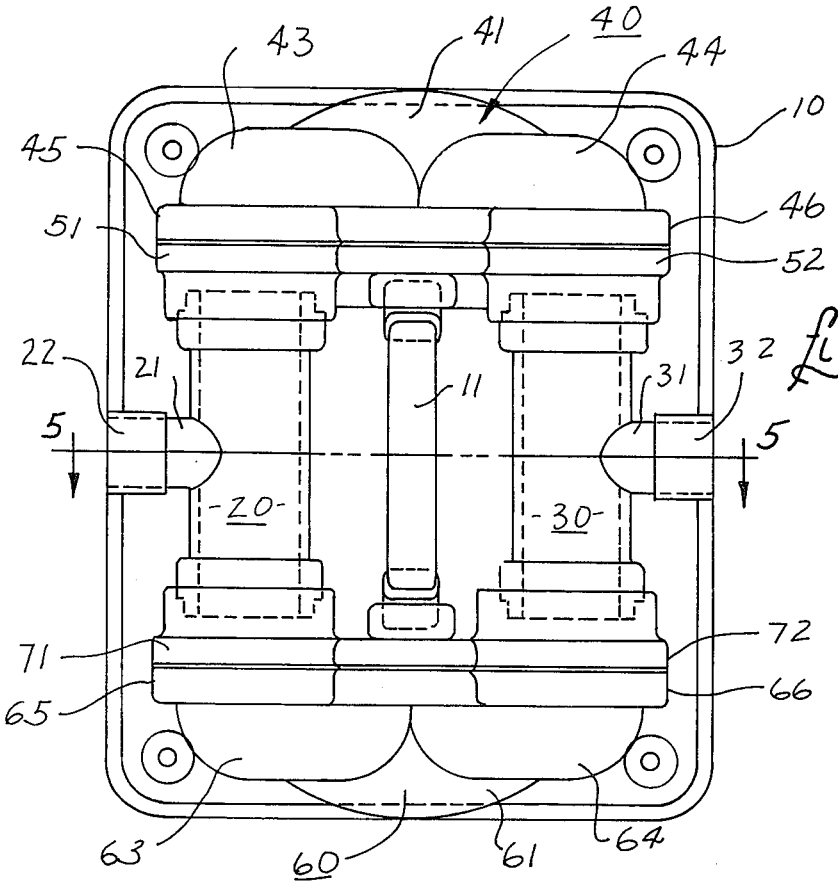
FIG. 1 is a plan view of a double diaphragm pump embodying the invention.

Referring more particularly to the drawings, there is shown a double-diaphragm pump embodying the invention and adapted to pump a liquid, slurry, suspension, or other flowable material. For the purpose of illustration, the double-diaphragm pump to be shown and described uses a liquid under pressure or compressed air as the primary source of pumping fluid, such as water from an outlet tap in a standard water utility system or compressed air from a compressor.

The pump is mounted on a flat base 10, and includes as basic components an inlet manifold 20 and an outlet manifold 30 for the material being pumped, a pair of identical chamber housings 40 and 60, and a central housing 80. In accordance with the invention, the chamber housings 40 and 60 and central housing 80 may be formed of a molded plastic material such as Delrin or other moldable engineering grade plastic. The utilization of plastic material for various components of the pump reduces cost, simplifies construction, and affords other advantages as compared with cast metal components.

Figure 2:
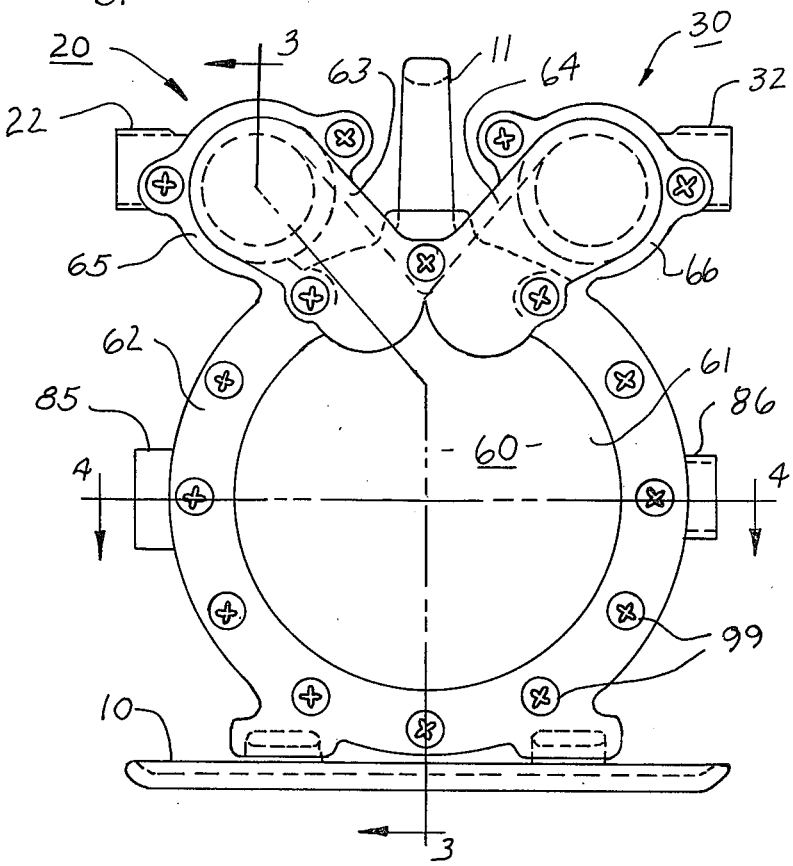
FIG. 2 is an end elevation of the double-acting diaphragm pump of FIG. 1.
Figure 5:
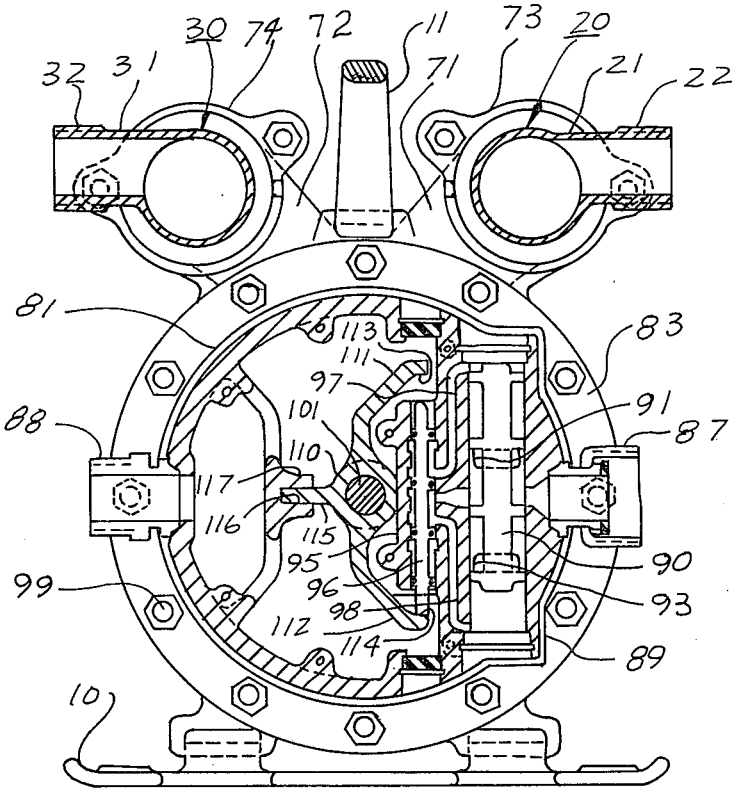
FIG. 5 is a sectional view, taken on the line 5—5 of FIG. 1.

While in the embodiment shown, the inlet and outlet manifolds 20 and 30 are located at the top of the pump (FIGS. 2 and 5), it should be noted that the pump is reversible and can be oriented with the manifolds 20 and 30 located at the bottom in order to assure that where the material being pumped contains solids in suspension, the solids are conveyed out of the pump and do not settle in the pumping chambers. The orientation shown, with the manifolds 20 and 30 located at the top, is more advantageous when the material being pumped contains gas in suspension that might otherwise be trapped in the pumping chambers. This arrangement requires, of course, that the check valves used be non-position-sensitive. It is to be noted that although top or bottom orientations of manifolds is preferred, the pump is operable with the manifolds in various intermediate positions, if required.

The inlet manifold 20 has an inlet 21, with a conventional fitting 22 to permit connection to a flexible water hose, for example. Also, one-way check valves 25 and 26 (see FIG. 3) are located at opposite ends of the inlet manifold 20 to control the flow of fluid through the pump during the reciprocating movement.

The outlet manifold 30 has an outlet 31 with a fitting 32 for accommodating an inlet conduit such as a water hose. Also, the manifold 30 has one-way check valves, similar to valves 25 and 26, to control the fluid flow during the pumping strokes.

While various types of one-way valves may be successfully used in the pump, as will be apparent to those skilled in the art, the particular one-way valves 25 and 26 shown herein are novel, specially designed valves that are described and shown in my copending patent application Ser. No. 378,920, filed May 17, 1982.

The chamber housings 40 and 60 are essentially identical. The various parts thereof are numbered consecutively in identical order, the parts of housing 40 starting with number 41 and the parts of housing 60 starting with number 61. Each housing has an outer wall member 41 and 61 (FIG. 3), with a radial mounting flange 42 and 62, a radially extending inlet duct 43 and 63, and an adjacent radially extending outlet duct 44 and 64. Each inlet duct 43 and 63 has a mounting flange 45 and 65 and, likewise, each outlet duct 44 and 64 has a radial flange 46 and 66.

In order to facilitate the forming of the outer wall members 41 and 61, the construction of the ducts 43, 44, 63, and 64 is completed after the initial molding operation. To accomplish this, wall inserts 47 and 67 are secured in place, such as with cement, in the inlet ducts 43 and 63, and inserts 48 and 68 are inserted in the outlet ducts 44 and 64 after the initial molding in order to define the respective passages.

Each chamber housing 40 and 60 also has an inner wall member 49 and 69, with a radial flange 50 and 70 and with a pair of radial extensions 51 and 52 and 71 and 72 that cooperate with the inlet and outlet ducts 43, 44, 63, and 64 of the outer wall members 41 and 61.

Each extension 51 and 71 has a mounting flange 53 and 73 and, likewise, each radial extension 52 and 72 has a mounting flange 54 and 74.

Each chamber housing has a flexible diaphragm 55 and 75 mounted therein, with its circumferential portion clamped between the flanges 42 and 50 on the one hand and 62 and 70 on the other hand. The flexible diaphragms 55 and 75 separate their respective chamber housings 40 and 60 into outer pressure chambers 56 and 76 and inner pressure chambers 57 and 77. The outer pressure chambers 56 and 76 communicate with the inlet and outlet ducts 43, 63, and 44 and 64, respectively.

The inner wall members 49 and 69 each have a port 58 and 78 through which pumping fluid enters and is exhausted. Also, the wall members 49 and 69 each have a central opening 59 and 79 formed therein for the connecting rod assembly that connects the diaphragms 55 and 75 together for alternating pumping strokes.

The central housing 80 comprises two identical housing sections 81 and 82 which may be formed in the same mold and which are adhered together in reverse relationship, using cement or other suitable fastening means. The resulting housing 80 is generally tubular and has radial flanges 83 and 84 at its opposite ends which cooperate with the radial flanges 42, 62, 50 and 70 of the chamber housings 40 and 60 to provide for the connection of the chamber housings 40 and 60 to the central housing, and thus to one another, to complete the assembly.

The resulting central housing 80 defines a fluid inlet 85 at one side and a fluid outlet 86 at the opposite side, the inlet 85 being provided with an inlet fitting 87 and the outlet 86 likewise being provided with an outlet fitting 88. The fittings 86 and 88 may be conventional hose connectors for conventional garden hoses. Inside, the housing sections 81 and 82 define a reversing valve housing 89 (FIG. 5) for a reversing valve 90 that is adapted for reciprocating sliding movement in its housing 89 to control the alternating supply of pumping fluid to the inner pressure chambers 57 and 77. Also, the housing sections 81 and 82 define fluid passages 91 and 92 communicating with the fluid ports 58 and 78 for the inner pressure chambers 57 and 77, as well as exhaust ports 93 and 94 through which pumping fluid is exhausted to the interior space in the central housing 80.

Adjacent the reversing valve housing 89 is a pilot valve housing 95 for a pilot valve 96 that reciprocates therein in response to movement of the flexible diaphragms 55 and 75. A pair of pilot passages 97 and 98 communicate between the pilot valve housing 95 and the reversing valve housing 89 in order to effect control of the reversing valve 90 by the pilot valve 96, as will be readily apparent to those skilled in the art. The chamber housings 40 and 60 are secured to the central housing 80 by bolts 99 that extend through the respective flanges 42, 50, and 83 on the one hand and 62, 70, and 84 on the other hand, the bolts being uniformly spaced around the circumference of the central housing 80.

As indicated below, the flexible diaphragms 55 and 75 are connected to one another by a connecting rod assembly 100 that extends through the central housing 80 and reciprocates back and forth therein. The connecting rod assembly 100 comprises a rod 101 with threaded ends 102 and 103 and an enlarged central portion 104. The shoulder at one end of the central portion 104 bears against a retainer plate 105, which, together with another retainer plate 106, serves to clamp the diaphragm 55 therebetween. The threaded portion 103 is threadedly received in the retainer plate 106, as indicated in FIGS. 3 and 4.

Figure 3:
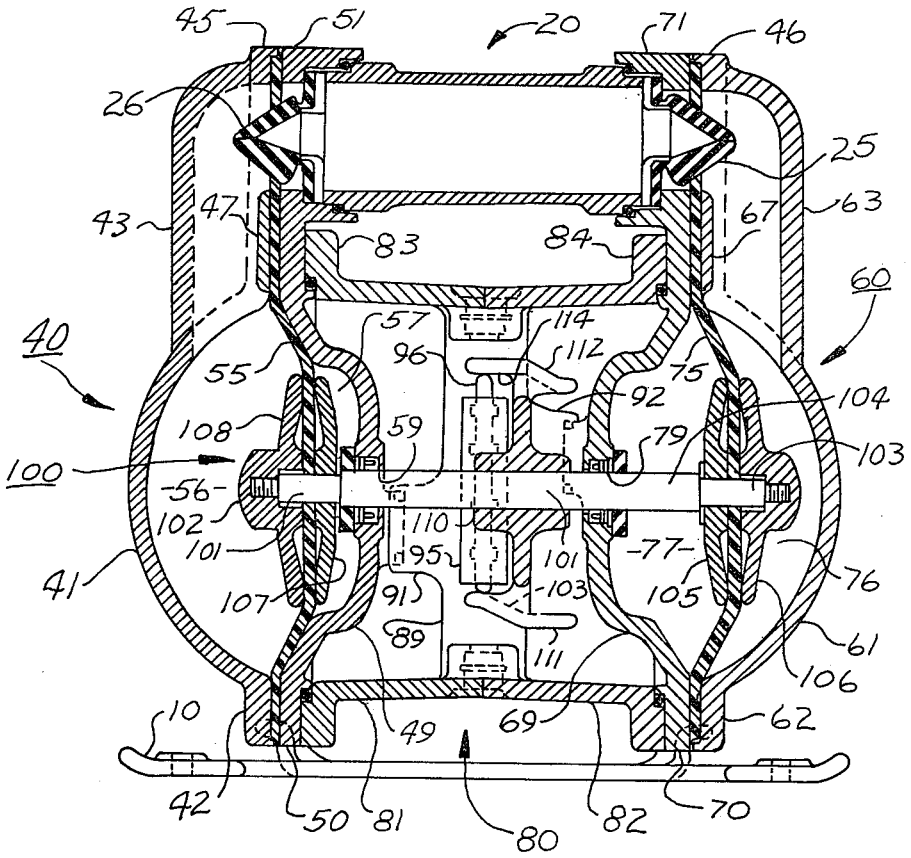
FIG. 3 is a sectional view, taken on the line 3—3 of FIG. 2.
Figure 4:
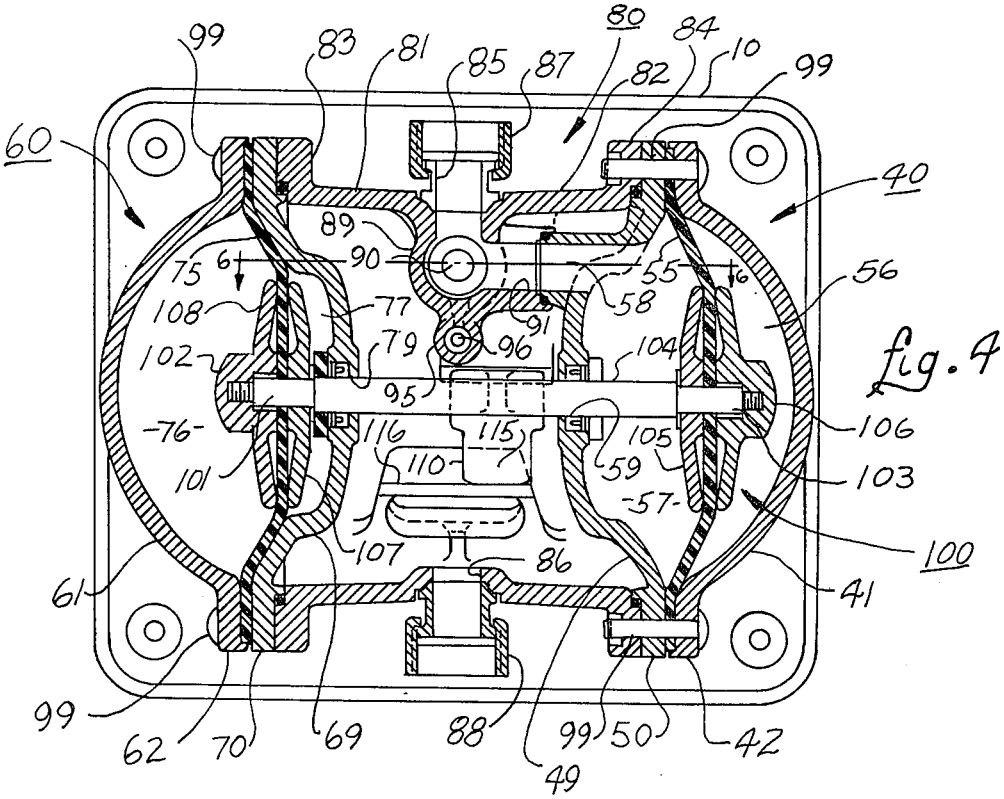
FIG. 4 is a sectional view, taken on the line 4—4 of FIG. 2.
Figure 6:
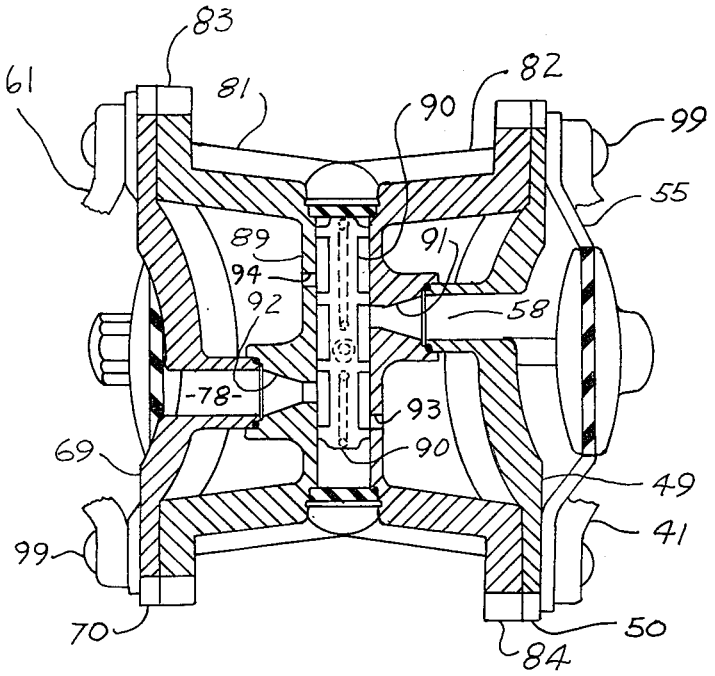
FIG. 6 is a fragmentary, sectional view, taken on the line 6—6 of FIG. 4.

The shoulder at the other end of the central portion 104 bears at the other end against a retainer plate 107, which, together with a retainer plate 108, clamps the flexible diaphragm 75 therebetween, as indicated in FIGS. 3 and 4. The plates 105, 106, 107, and 108 assure that the flexing of the diaphragms 55 and 75 occurs in a circular zone spaced outwardly from the center of the respective diaphragms to better distribute flexing loads.

A pilot valve operator 110 is mounted on the rod 101 midway between its ends, and is adapted to shift the pilot valve 96 back and forth in response to the movement of the connecting rod assembly 100 in order to control the reversing valve 90. The pilot valve operator 110 has a generally bifurcated form with a pair of radially extending operating arms 111 and 112 that extend outwardly toward the opposite ends of the pilot valve 96. The outer ends of the arms 11 and 12 have cam surfaces 113 and 114 formed thereon that engage opposite ends of the pilot valve 96, as illustrated in FIG. 3, and which slide the pilot valve back and forth in response to movement of the cam surfaces 113 and 114 in an axial direction relative to the connecting rod assembly 100. The pilot valve operator 110 is axially positioned on the rod 101 by a pin and rotation of the operator 110 is prevented by a radially extending guide plate 115 that is slidably received in a guide slot 116 formed at an inwardly extending projection 117 located on the inner surface of the central housing 80.

OPERATION

As indicated above, the double diaphragm pump of the invention is capable for use with either gas or liquid as the pumping fluid; however, the particular pump herein shown and described is adapted to be operated by water supplied from a public water system. Preferably, the water is supplied and exhausted through typical garden hoses or the like so that the pump may be located in any temporary location. The water under pressure enters through the fluid inlet fitting 87 and from there enters the reversing valve chamber. The reversing valve controls the flow of water through one or the other of the fluid passages 91 and 92 to one or the other of the inner pressure chambers 57 and 77, where the pressure forces the respective flexible diaphragm 55 or 75 in an outward direction and, at the same time, draws the opposite diaphragm 55 or 75 in the opposite or inward direction. During this movement, the connecting rod assembly 100 carries the pilot valve operator 110 in the same direction, and toward the end of the stroke the respective cam surface 113,114 of the respective operating arm 111, 112 engages the outwardly extending end of the pilot valve 96 and forces it in the opposite direction. This movement ultimately causes water pressure to be applied to one end of the reversing valve chamber and begins to force the reversing valve in the opposite direction. Ultimately, the reversing valve changes the porting so that fluid pressure is applied to the opposite inner pressure chamber and fluid in the formerly expanded chamber is exhausted through the reversing valve housing to the space within the central housing 80.

From the interior of the central housing 80, the water is exhausted through the fluid outlet 86.

The resulting movement of the flexible diaphragms 55 and 75 results in the pumping of liquid material to be pumped through the outer pressure chambers 56 and 76 in an alternating manner, the inlet and exhaust of liquid through the manifolds 20 and 30 being controlled by the one-way valves 25, 26, 35, and 36, as will be readily apparent to those skilled in the art.

In accordance with one application of the pump shown and described, the material to be pumped comprises a solution of soluble fertilizer in water that has been mixed together in a large drum or other container and is pumped by the double-acting diaphragm pump from the barrel to a device for distributing the fertilizer. A typical type of device might be a tube that is inserted in the soil and through which the fertilizer solution may be distributed to the roots of trees, shrubs, etc.

With the system thus conceived, the fertilizer solution is exhausted from one drum or other container, while at the same time the pumping fluid or water exhausted from the pump is exhausted into a second drum or other container wherein it is mixed with soluble fertilizer until it is completely filled. The first drum will be emptied at approximately the same time that the second drum is filled, and when this is accomplished, the inlet lines are reversed so that the fertilizer solution in the second drum or other container is pumped to its ultimate destination while exhausted fluid is placed in the first container or drum.

It will be noted that the design of the pump shown and described greatly facilitates the fabrication and assembly thereof, especially in view of the unique design of the central housing 80 using the two identical housing sections 81 and 82 and through the unique design of the pilot valve operator 110 using the camming action to shift the pilot valve back and forth.

This design enables the pump to be fabricated primarily from molded plastic parts which are readily assembled to form a sturdy, reliable unit.

While the invention has been shown and described with respect to a specific embodiment thereof, this is intended for the purpose of illustration rather than limitation, and other modifications and variations of the specific device herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. A fluid-operated pump comprising:

a central housing;

a pair of chamber housings each disposed at an opposite side of said central housing;

a pair of pumping members one in each of said chamber housings and dividing the interior of said chamber housings into inner and outer pressure chambers;

inlet and discharge manifolds disposed to communicate with said outer pressure chambers and having one-way check valves therein and secondary inlet and outlet ports, respectively;

connecting rod means connecting said pumping members together for common reciprocatory movement in their respective chamber housings;

said central housing comprising a pair of identical molded housing sections each having a planar joining surface whereby said sections are joined to one another in reverse relationship with the respective planar surfaces mated with one another in a central plane perpendicular to the axis of said connecting rod means to define inlet and outlet ports and passage means connecting said inlet and outlet ports to said inner chambers, said passage means including a reversing valve chamber and a pilot valve chamber, said inlet port being adapted for connection to a source of fluid under pressure;

a reversing valve movably mounted in said reversing valve chamber for controlling the supply of said fluid under pressure to alternate from one inner chamber to another;

a pilot valve movably mounted in said pilot valve chamber for controlling the movement of said reversing valve, said pilot valve comprising an elongated member adapted for reciprocating linear movement in a direction perpendicular to the direction of movement of said connecting rod means;

the axes of said reversing valve and said pilot valve being in said central plane perpendicular to the axis of said connecting rod and centered between said chamber housings; and a pilot valve operating member secured to said connecting rod means and having radially extending bifurcations with a camming surface therein adapted to alternately engage said elongated member of said pilot valve to shift said valve between its operating positions in response to reciprocating movement of said pumping members.

2. A fluid-operated pump as defined in claim 1, wherein the direction of reciprocating movement of said connecting rod means is essentially in a horizontal plane.

3. A fluid-operated pump as defined in claim 1, wherein said outer pressure chambers each define an inlet passage communicating with said inlet manifold and an outlet passage communicating with said outlet manifold, said passages being adjacent one another and extending outwardly from their respective outer pressure chamber in a generally vertical direction away from said horizontal plane.

4. A fluid-operated pump as defined in claim 3, wherein said pump is adapted to be placed selectively in a first position wherein said outer chamber inlet and outlet passages extend upwardly and in a second position wherein said outer chamber inlet and outlet ports extend downwardly.

5. A fluid-operated pump as defined in claim 1, wherein said pilot valve operating member has a central hub positioned on said connecting rod and secured against axial movement relative thereto and means slidably keying said hub to said central housing to accommodate reciprocating movement of said connecting rod and to prevent rotary movement of said hub relative to said central housing.

6. A fluid-operated pump as defined in claim 5, wherein said keying means includes a key extending radially from said hub and means forming a slot in said central housing adapted to slidably receive said key.

7. In a fluid-operated pump including:

a central housing, a pair of chamber housings each disposed at an opposite side of said central housing, a pair of pumping members, one in each of said chamber housings and dividing the interior of said chamber housings into inner and outer pressure chambers, means defining inlet and discharge manifolds communicating with said outer pressure chambers, said means including one-way check valves, and connecting rod means connecting said pumping members together for common reciprocating movement in their respective chambers;

the improvement wherein said central housing comprises a pair of identical molded housing sections joined to one another in a central plane perpendicular to the axis of said connecting rod means and in reverse relationship to define inlet and outlet ports and passage means connecting said inlet and outlet ports to said inner chambers, said passage means including a reversing valve chamber and a pilot valve chamber, a reversing valve movably mounted in said reversing valve chamber for controlling the supply of fluid under pressure alternately to said chambers, a pilot valve movably mounted in said pilot valve chamber for controlling the movement of said reversing valve, the axes of said reversing valve and said pilot valve being parallel to one another and in said central plane perpendicular to said connecting rod means, and means centrally mounted on said connecting rod for shifting said pilot valve.

8. A fluid-operated pump as defined in claim 7, wherein the reciprocating movement of said connecting rod means is essentially in a horizontal plane.

9. A fluid-operated pump as defined in claim 7, wherein said molded housing sections comprise a moldable engineeering grade plastic.

* * * * *